US008188391B2

(12) United States Patent
Ma

(10) Patent No.: US 8,188,391 B2
(45) Date of Patent: May 29, 2012

(54) VIBRATION SWITCH AND CIRCUIT USING THE SAME

(75) Inventor: Xian-Wei Ma, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 249 days.

(21) Appl. No.: 12/727,240

(22) Filed: Mar. 19, 2010

(65) Prior Publication Data

US 2011/0042188 A1 Feb. 24, 2011

(30) Foreign Application Priority Data

Aug. 20, 2009 (CN) ..... 2009 1 0305835

(51) Int. Cl.
*H01H 35/14* (2006.01)

(52) U.S. Cl. ..... 200/61.45 R

(58) Field of Classification Search ..... 200/641.45 R, 200/61.48, 61.51, 61.52
See application file for complete search history.

(56) References Cited

U.S. PATENT DOCUMENTS

| | | | | |
|---|---|---|---|---|
| 3,452,175 | A * | 6/1969 | Wilkes | 200/503 |
| 3,731,022 | A * | 5/1973 | Loftus | 200/61.49 |
| 5,134,255 | A * | 7/1992 | Tetrault et al. | 200/61.45 R |
| 5,153,393 | A * | 10/1992 | Breed et al. | 200/61.45 R |
| 5,481,139 | A * | 1/1996 | Lucas | 200/61.45 R |
| 6,348,665 | B1 * | 2/2002 | Ohashi et al. | 200/61.52 |
| 6,555,772 | B1 * | 4/2003 | Chou | 200/61.45 R |
| 6,740,867 | B2 * | 5/2004 | Chou | 250/231.1 |
| 7,084,759 | B2 * | 8/2006 | Cox et al. | 340/540 |
| 2003/0066742 | A1 * | 4/2003 | Chou | 200/61.45 R |
| 2008/0072676 | A1 * | 3/2008 | Peng | 73/649 |

* cited by examiner

*Primary Examiner* — Briggitte R Hammond
(74) *Attorney, Agent, or Firm* — Altis Law Group, Inc.

(57) ABSTRACT

A vibration switch is provided. The vibration switch includes a housing; a plurality of conductive members are received in the housing and spaced apart from each other; a biasing member is suspended in the housing; a plurality of wires electrically connected to the conductive members and the biasing member respectively; wherein, when the housing receives a vibration, the biasing member is deflected and contacts one of the conductive members, thereby making an electrical connection between the biasing member and the conductive member. A circuit using the vibration switch is also provided.

10 Claims, 3 Drawing Sheets

VIBRATION SWITCH AND CIRCUIT USING THE SAME

BACKGROUND

1. Technical Field

The disclosure relates to a vibration switch and a circuit using the same.

2. Description of Related Art

A conventional vibration switch includes a housing, a movable portion, and a fixed portion. The movable portion and the fixed portion are connected to a circuit. Once the housing receives a vibration, the movable portion is deflected to contact with the fixed portion, and thus the circuit is closed. However, this conventional vibration switch can only control a circuit. So we need to provide a vibration switch, which is capable of controlling a plurality of circuits.

BRIEF DESCRIPTION OF THE DRAWINGS

The components of the drawings are not necessarily drawn to scale, the emphasis instead being placed upon clearly illustrating the principles of the vibration switch and the circuit using the same. Moreover, in the drawings, like reference numerals designate corresponding parts throughout several views.

DETAILED DESCRIPTION

Figure 1:
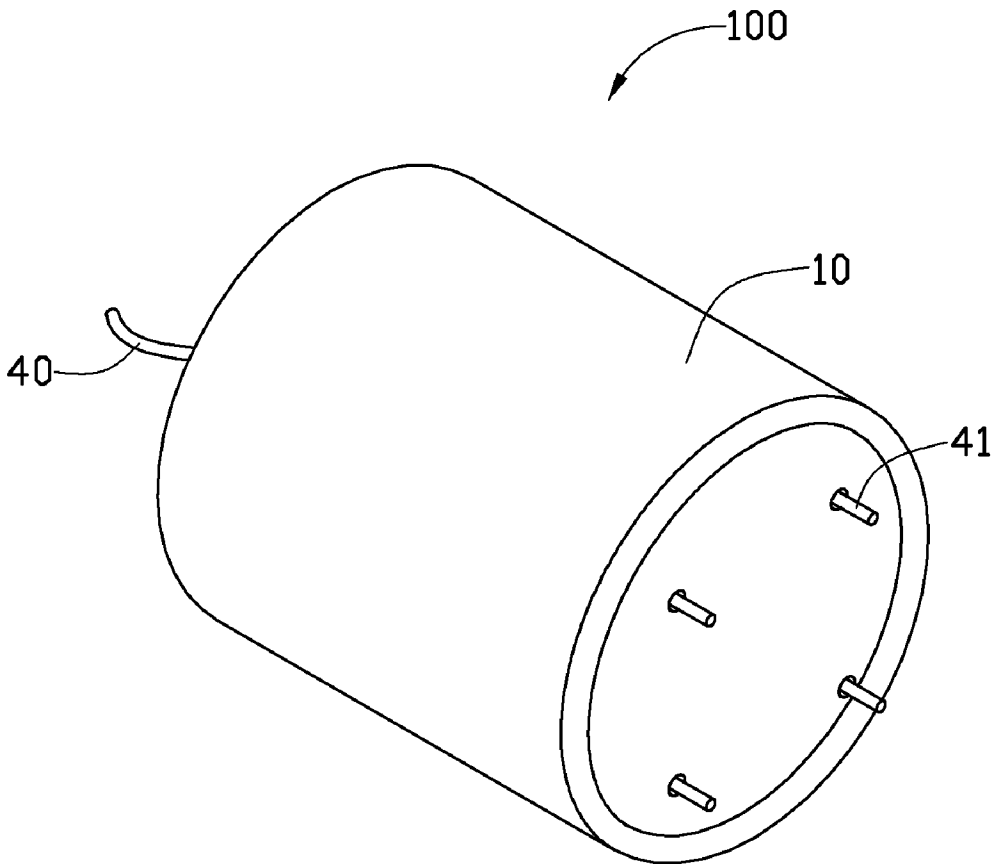
FIG. 1 is a schematic, isometric view of a vibration switch in accordance with an exemplary embodiment.
Figure 2:
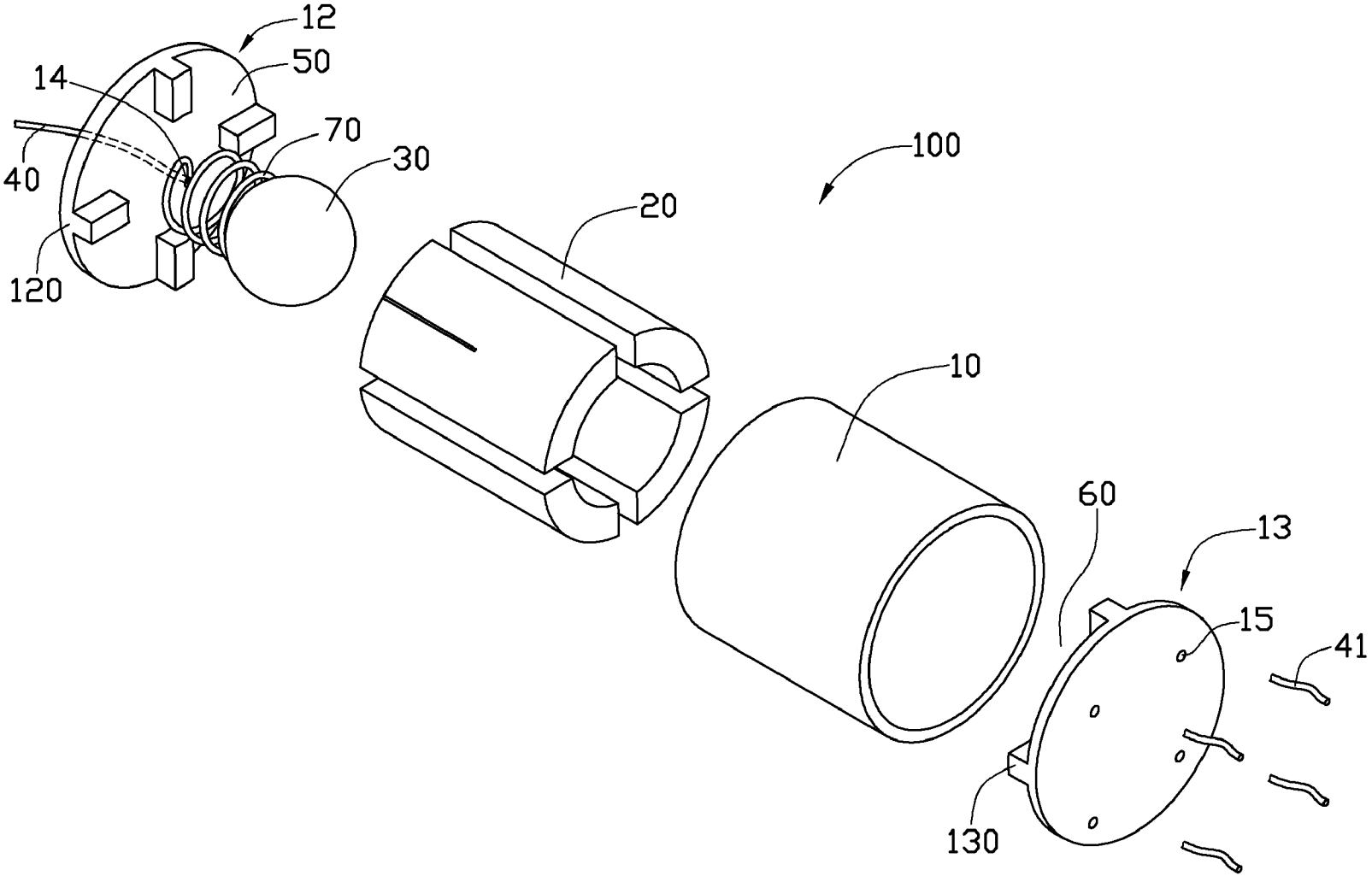
FIG. 2 is an exploded view of the vibration switch of FIG. 1.

Referring to FIGS. 1 and 2, a vibration switch 100 includes an electrically insulated housing 10, a plurality of conductive members 20, a biasing member 30 mounted in the housing 10, a wire 40, and a plurality of wires 41. The vibration switch 100 is substantially cylindrical. The conductive members 20 and the biasing member 30 are made of conductive materials.

The vibration switch 100 further includes a first cover 12 and a second cover 13. The housing 10 is hollow and includes two open ends. The first cover 12 and the second cover 13 are attached to the two open ends of the housing 10, respectively. The first cover 12 defines a through hole 14 in its center. The second cover 13 defines four through holes 15.

An inner surface of the first cover 12 includes four protruding portions 120, while an opposite inner surface of the second cover 13 includes four protruding portions 130. Two adjacent protruding portions 120 define a receiving space 50, while two adjacent protruding portions 130 define a receiving space 60.

In the exemplary embodiment, the number of the conductive members 20 is four. The conductive members 20 are received in the housing 10 and spaced apart from each other. Two ends of each conductive member 20 are retained within corresponding receiving space 50 and 60, respectively. The ends of the conductive members 20 retained in the receiving space 60 are electrically connected with the wires 41. The wires 41 are guided out through the through holes 15 respectively and connected to one end of a circuit 200 (see FIG. 3).

The biasing member 30 is received in the housing 10. The biasing member 30 includes a spring 31 and a metal ball 32. The spring 31 is an electrically conductive coil spring. One end of the spring 31 is fixed to the inner surface of the first cover 12 and is electrically connected to the wire 40. The wire 40 is guided out through the through hole 14 and connected to another end of the circuit 200. The metal ball 32 is fixed to the other end of the spring 31.

When the vibration switch 100 does not receive a vibration, the metal ball 32 remains suspended in the space defined by the conductive members 20 and does not contact the conductive members 20, and thus, the vibration switch 100 remains open. When the vibration switch 100 receives a vibration, namely the housing 10 is vibrated, the biasing member 30 is deflected, the metal ball 32 contacts one of the conductive members 20, thereby making an electrical connection between the biasing member 30 and the conductive member 20, and thus, the vibration switch 100 closes.

Figure 3:
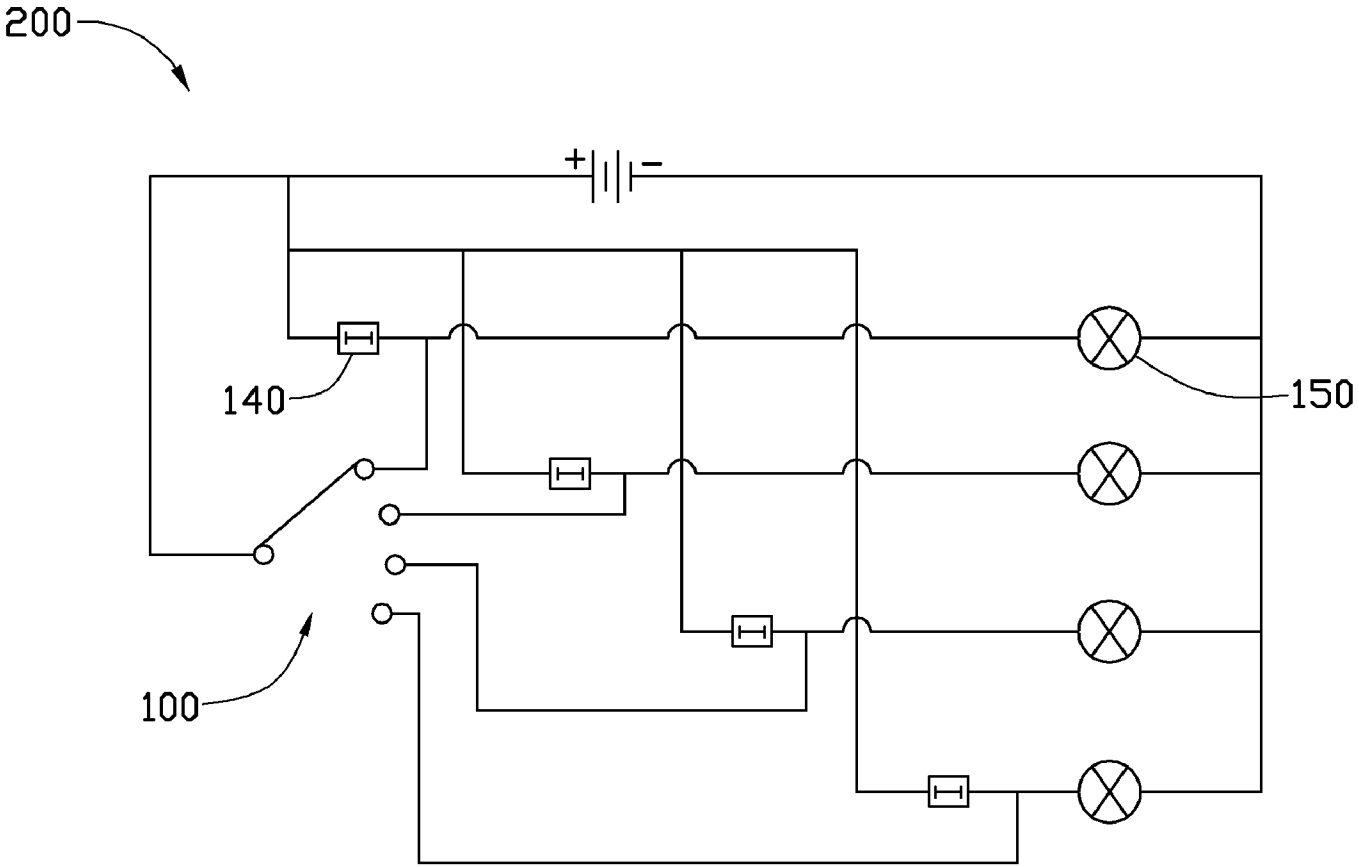
FIG. 3 is a schematic view of a circuit using the vibration switch of FIG. 1.

Referring to FIG. 3, a circuit 200 using the vibration switch 100 is disclosed. The circuit 200 includes four time relays 140 and four electronic apparatus 150 (e.g., LEDs). Each conductive member 20 of the vibration switch 100 is connected to a time relay 140 and an electronic apparatus 150, each connected time relay 140 and corresponding electronic apparatus 150 form a loop.

The time relay 140 has a predetermined running time S1. When the loop where the time relay 140 is deposited is closed, namely the housing 10 is vibrated, and the metal ball 32 contacts the conductive member 20, the time relay 140 in the loop is activated to keep the loop closed for the running time S1, and opens automatically when the running time S1 elapses. In other words, the time relay 140 controls the electric apparatus 150 to work for the running time S1.

Because the vibration switch 100 includes a plurality of conductive members 20 and each of the conductive members 20 forms a loop with a corresponding electronic apparatus 150, the vibration switch 100 is capable of controlling a plurality of loops.

Although the present disclosure has been specifically described on the basis of the exemplary embodiment thereof, the disclosure is not to be construed as being limited thereto. Various changes or modifications may be made to the embodiment without departing from the scope and spirit of the disclosure.

What is claimed is:

1. A vibration switch comprising:

a housing;

a plurality of conductive members receiving in the housing and spacing apart from each other;

a biasing member suspending in the housing;

a plurality of wires electrically connecting to the conductive members and the biasing member respectively;

wherein, when the housing receives a vibration, the biasing member is deflected and contacts one of the conductive members, thereby making an electrical connection between the biasing member and the conductive member.

2. The vibration switch as described in claim 1, wherein the vibration switch further comprises a first cover and a second cover, the housing comprises two open ends, the first cover and the second cover are attached to the two open ends of the housing, respectively.

3. The vibration switch as described in claim 2, wherein an inner surface of the first cover comprises a plurality of protruding portions, an opposite inner surface of the second cover comprises a plurality of protruding portions.

4. The vibration switch as described in claim 3, wherein two adjacent protruding portions define a receiving space, two ends of one of the plurality of conductive members are retained within the receiving spaces, respectively.

5. The vibration switch as described in claim 1, wherein the biasing member comprises a spring and a metal ball, the spring is an electrically conductive coil spring, and one end of the spring is fixed to the inner surface of the first cover, the other end is fixed to the metal ball.

6. A circuit using a vibration switch, comprises a plurality of time relays and electronic apparatus, each conductive member of the vibration switch is connected to a time relay and an electronic apparatus, the connected time relay and the electronic apparatus form a loop, wherein the vibration switch comprising:

a housing;

a plurality of conductive members receiving in the housing and spacing apart from each other;

a biasing member suspending in the housing;

a plurality of wires electrically connecting to the conductive members and the biasing member respectively;

wherein, when the housing receives a vibration, the biasing member is deflected and contacts one of the conductive members, thereby making an electrical connection between the biasing member and the conductive member.

7. The circuit using a vibration switch in claim 6, wherein the vibration switch further comprises a first cover and a second cover, the housing comprises two open ends, the first cover and the second cover are attached to the two open ends of the housing, respectively.

8. The circuit using a vibration switch in claim 7, wherein an inner surface of the first cover comprises a plurality of protruding portions, an opposite inner surface of the second cover comprises a plurality of protruding portions.

9. The circuit using a vibration switch in claim 8, wherein two adjacent protruding portions define a receiving space, two ends of each conductive member are retained within corresponding receiving spaces, respectively.

10. The circuit using a vibration switch in claim 6, wherein the biasing member comprises a spring and a metal ball, the spring is an electrically conductive coil spring, and one end of the spring is fixed to the inner surface of the first cover, the other end is fixed to the metal ball.

* * * * *